United States Patent [19]

Winckler et al.

[11] Patent Number: 4,584,060

[45] **Date of Patent: * Apr. 22, 1986**

[54] LOW TEMPERATURE CARBONIZATION PROCESS FOR COAL HYDROGENATION RESIDUES

[75] Inventors: Lothar Winckler, Gladbeck; Klaus Fuhrmann, Dorsten; Ulrich Graeser, Haltern; Peter Wenning, Dorsten, all of Fed. Rep. of Germany

[73] Assignee: Veba Oel Entwicklungs-Gesellschaft mbH, Gelsenkirchen, Fed. Rep. of Germany

[ * ] Notice: The portion of the term of this patent subsequent to Apr. 22, 2003 has been disclaimed.

[21] Appl. No.: 660,970

[22] Filed: Oct. 15, 1984

[30] Foreign Application Priority Data

Oct. 15, 1983 [DE] Fed. Rep. of Germany ..... 3337622

[51] Int. Cl.[4] ..... C10B 47/44

[52] U.S. Cl. ..... 201/32; 201/35; 202/118

[58] Field of Search ..... 201/32, 33, 35, 25, 201/44, 41; 202/118, 270; 208/126, 177, 8 R, 11 R, 10

[56] References Cited

U.S. PATENT DOCUMENTS

| | | | |
|---|---|---|---|
| 1,428,458 | 9/1922 | Thompson | 202/118 |
| 1,810,828 | 6/1931 | Hayes | 201/33 |
| 1,817,926 | 8/1931 | McIntire | 201/33 |
| 2,072,721 | 3/1937 | Kahn | 201/33 |
| 3,075,912 | 1/1963 | Du Bois Eastman et al. | 208/107 |
| 3,691,019 | 9/1972 | Brimhall | 202/118 |
| 3,787,292 | 1/1974 | Keappler | 202/118 |
| 4,077,868 | 3/1978 | Chambers | 208/11 R |

FOREIGN PATENT DOCUMENTS

| | | |
|---|---|---|
| 326227 | 12/1920 | Fed. Rep. of Germany . |
| 619298 | 4/1935 | Fed. Rep. of Germany . |
| 737780 | 7/1943 | Fed. Rep. of Germany . |
| 2222267 | 11/1972 | Fed. Rep. of Germany . |
| 2520152 | 11/1975 | Fed. Rep. of Germany . |

*Primary Examiner*—Peter Kratz

*Attorney, Agent, or Firm*—Oblon, Fisher, Spivak, McClelland & Maier

[57] ABSTRACT

A method for low temperature carbonization of coal hydrogenation residues, wherein a coal hydrogenation residue is subjected to a reduced pressure distillation in a one-shaft or multishaft screw extruder, liberated gases and vapors are drawn off, and non-volatilized remaining material is subjected to low temperature carbonization in a screw extruder.

13 Claims, 1 Drawing Figure

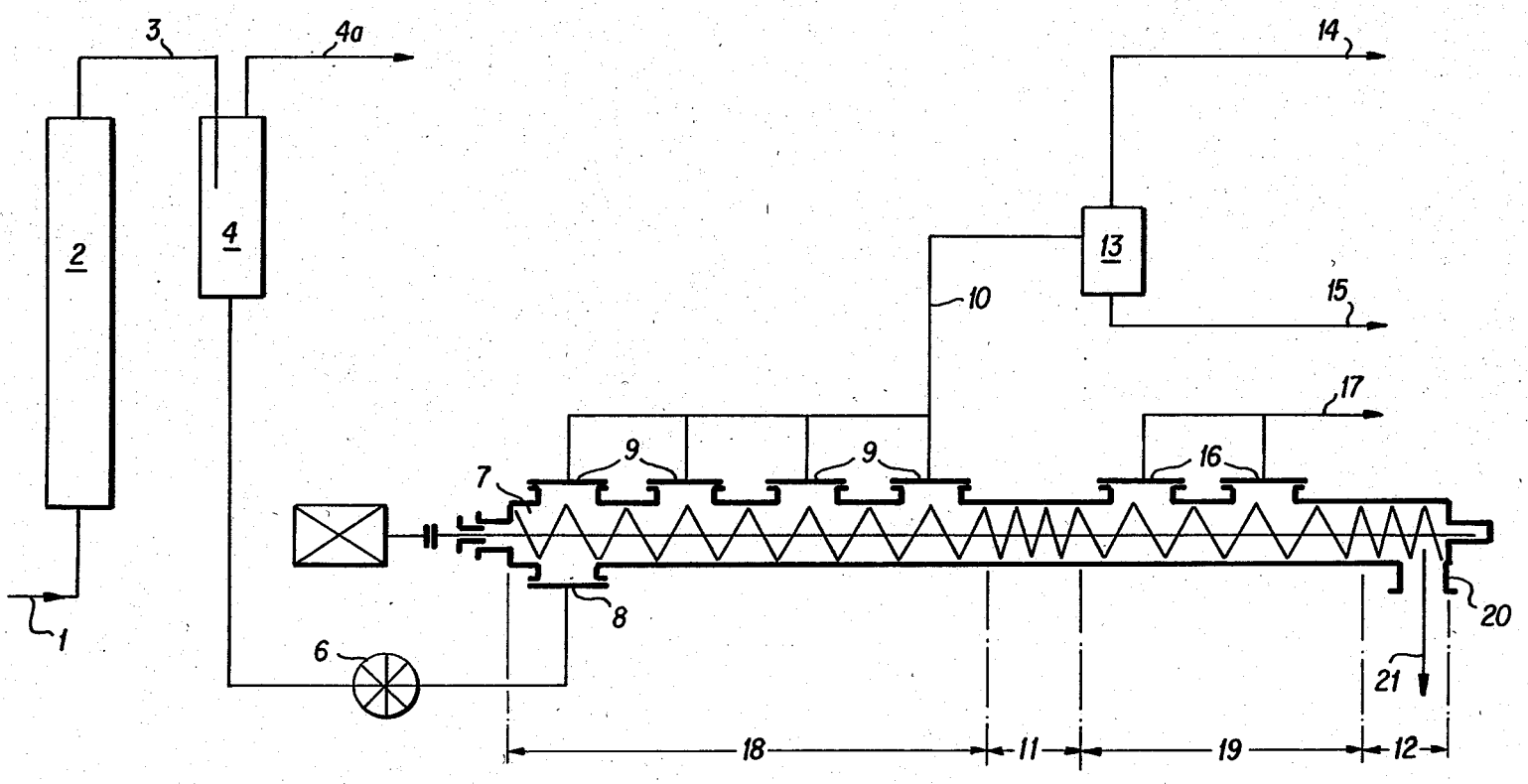
1
2
3
4
4a
6
7
8
9
9
10
11
12
13
14
15
16
17
18
19
20
21

LOW TEMPERATURE CARBONIZATION PROCESS FOR COAL HYDROGENATION RESIDUES

BACKGROUND OF THE INVENTION

1. Field of the Invention

The invention pertains to the field of coal hydrogenation and techniques based on coal hydrogenation especially relating to recovery of valuable volatile components from coal hydrogenation products.

2. Background of the Invention

Coal hydrogenation methods are known wherein the coal is hydrogenated by reaction with hydrogen at 250 to 550° C. (preferably 350° to 490° C. and pressures of 50 to 700 bar (preferably 100 to 350 bar), particularly in the presence of catalysts. At room temperature the products comprise solid residues and highly viscous liquid residues, along with liquid and gaseous hydrocarbons. Either coals or lignites or both may be employed in the hydrogenation (see Kroenig, W., 1950, "The catalytic hydrogenation of coals, tars, and mineral oils", Springer Verlag, Berlin, Goettingen, Heidelberg). The associated technology was developed to the feasible stage in the years 1920 to 1945, and was put into practice. The basic processes are those known as the Bergius-Pier and Pott-Broche methods.

New techniques building on these processes have been developed recently and have been tested on the bench or pilot scale. These include the EDS-Technology, SRC, H-Coal, and Neue Deutsche Technolgie processes. The latter has been undergoing testing since 1981 in the Bottrop large scale research facility (see Frank, H. G. and A. Knop, 1979, "Coal refining", Springer Verlag, Berlin, Heidelberg, New York, pp. 228–251).

All these processes have the common feature that the hydrogenation residues are separated from the gaseous and liquid products in hot separators wherein the phase separation takes place at the pressure and temperature of the reaction, or at the pressure of the reaction and at temperature slightly below the reaction temperature employed. In this connection the further processing of the hydrogenation residues is of interest, since these residues comprise valuable particular volatile product oils, in additon to solid materials such as unconverted coal, ash, catalysts, and non-volatile liquids or viscous intermediate products such as asphaltenes and preasphaltenes. The said valuable volatile product oils should be separated out to increase the yield of liquid products.

Low temperature carbonization or vacuum distillation is employed, among other methods, to separate out these volatile oil components in the residue. The oils recovered may be employed as slurry oils or slurry oil components for the process coal employed in the hydrogenation process. The low temperature carbonization is carried out in spherical furnaces or screw furnaces. The volatile oils themselves decompose pyrolytically during the carbonization process, so that valuable products of the hydrogenation are lost. The volatile oils can be separated out by vacuum distillation of the hydrogenation residue. The oils recovered are valuable as comminution oils. They also may be further hydrogenated under relatively mild conditions. However, there are substantial problems associated with the handling of the residue from the vacuum distillation. It is very difficult to remove from the vacuum distillation column and to transport for further processing, due to the high viscosity of the material and high solids content.

SUMMARY OF THE INVENTION

The problem underlying the present invention is to overcome these difficulties and improve the overall yield of liquid products from the process. This problem is solved according to the invention in that the coal hydrogenation residue is subjected to a reduced pressure distillation in a one-shaft or multishaft screw extruder, wherein the volatile fraction is withdrawn and the remaining material is subjected to low temperature carbonization in the screw extruder. The hydrogenation residue is continuously worked in a rotational mode by the screw(s) of the apparatus during the vacuum distillation and the low temperature carbonization. Said worm(s) convey the residue through the distillation zone and the low temperature carbonization zone of the apparatus while at the same time its viscosity is continuously increasing, as first the volatile components are withdrawn from it in the vacuum distillation and then the volatile materials which are recoverable by pyrolysis are withdrawn.

One-shaft or multishaft screw extruders with gas or vapor withdrawal are known, e.g. from U.S. Pat. Nos. 1,156,096 and 2,615,199. They are particularly used in plastics manufacturing, where they serve, among other things, as extruders to remove gases and monomers from polymerization mixtures (see M. Herrmann, 1972, "Screw extruders in process engineering", Springer Verlag, Berlin, Heidelberg, New York). Although the difficulties associated with oil separation have been known since the first coal hydrogenation on an industrial scale, for a long time vacuum screw extruders were not used for processing coal hydrogenation residues. The processing of hydrogenation residues involves different objectives from a process standpoint than the manufacturing of plastics. In the plastics industry the screw extruder comprises a part of the polymerization reactor, wherein the removal of the monomers in the vacuum zone is accompanied by interruption of the polymerization reaction, whereas in the case of coal hydrogenation the main objective is to concentrate the solids in the hydrogenation residue.

The recommended pressures for use in distilling the hydrogenation residue in the one-shaft or multishaft screw extruder are 0.01 to 0.6 bar, preferably 0.02 to 0.1 bar. According to a refinement of the invention, the pressure decreases over the length of the screw extruder beginning at the entry of the slurry-like hydrogenation residue and extending to the exit of said residue, said pressure range being as mentioned supra, with the pressure decreasing from the upper end to the lower end of said pressure range (0.6 to 0.01 bar, preferably 0.1 to 0.02 bar). This technique reduces the hazard of irregularities in the distillation process in the screw-extruder.

The temperature at which the distillation of hydrogenation residues is carried out in screw extruder is recommended to be in the range of 200° to 400° C., preferably 250° to 350° C. According to a refinement of the invention, the temperature increases over the length of the vacuum distillation zone of the screw extruder beginning at the entry of the hydrogenation residue and extending to the exit of said residue from the vacuum distillation zone, said temperature range being as mentioned supra, with the temperature increasing from the lower end to the upper end of said range (200° to 400°

C., preferably 250° to 350° C.), under conditions of constant or decreasing pressure over the length of the vacuum distillation zone. In this way the time for the hydrogenation residues to reach high temperatures which favor the undesired transformation is reduced, and further processing of the residue which is now freed of volatile components is facilitated.

Following the vacuum distillation, the non-volatilized material is heated to higher temperatures, preferably to 400° to 600° C., where it undergoes low temperature carbonization, which may be carried out at atmospheric pressure or a pressure below atmospheric. Advantageously, the screw extruder comprises a second zone for this operation, in addition to the first zone, the vacuum distillation zone or evaporation zone. The worm(s) then convey the remainder of the hydrogenation residue through this low temperature carbonization zone following the vacuum distillation zone. The vapors evolved in this process are drawn off separately from the oil vapors from the vacuum distillation. The resulting coke may ultimately be employed as, e.g., a fuel. According to the inventive method, residues can be processed in the vacuum distillation separation up to a final viscosity of about 2,000 mPa (at 250° C.).

The gaseous oils withdrawn from the screw-extruder may be advantageously employed as slurry oils, or may be combined with the usual hydrogenation oils, e.g. the gaseous hydrogenation products exiting the hot separator, and the combination may be subjected to further processing, such as additional hydrogenation.

The invention is suitable for processing all hydrogenation residues occurring in high pressure coal hydrogenation processes wherein coal is mashed with oil and is converted at high temperature and pressure with hydrogenation hydrogen, possibly in the presence of a catalyst; such a process is, e.g., the so-called Bergius-Pier process.

BRIEF DESCRIPTION OF THE DRAWING

The FIGURE depicts a preferred apparatus for carrying out the process of the invention. The drawing is further described in detail under the description of the preferred embodiment, infra.

DESCRIPTION OF THE PREFERRED EMBODIMENT

The invention will be further described with the aid of the following exemplary embodiment and the drawing.

A typical "Gasflamm" coal from the Ruhr region is comminuted and then mashed with slurry oil recycled from the process. The resulting mixture is then preheated and fed via line 1 along with the hydrogenation hydrogen and with the addition of an iron catalyst, to a hydrogenation reactor 2 at 300 bar and 470° C.

The conversion product leaves reactor 2 via line 3 and is fed to the hot separator 4 wherein the volatile products existing under the prevailing conditions are separated from the solid and liquid conversion products, at process pressure (ca. 300 bar) and 460° C.

These volatile products are withdrawn at the top via line 4*a* and are further processed in known fashion. After being brought to atmospheric pressure, the solid and liquid reaction products are sent via line 5 into the vacuum evaporator screw extruder 7 with integrated pressurization and low temperature carbonization zone.

The feed into the liquid space of the evaporator 7 is from the bottom, through line 8 in order to achieve a seal between the entering stream of hydrogenation products coming from the hot separator and the vacuum evaporation zone. A positive displacement pump system 6 is employed as the delivery means for the feed stream, and serves also as a dosing means.

In the screw extruder 7, furnished with a double screw, a pressure of 0.1 bar (absolute) is established via vacuum line 14. The hydrogenation residue employed, which is fed to the screw extruder 7 via pipe 8, contains 50 wt. % oil boiling at 325° C. and above, 15 wt. % high molecular weight components (determined to be asphaltene and pre-asphaltene in the amounts 10 and 5 wt. % of the total, respectively), and 35 wt. % inorganic components (24 wt. % represented by ash and the remaining 11 wt. % by unconverted coal). Of the said ash, 32 wt. % is $SiO_2$, 26 wt. % is $Al_2O_3$, 25 wt. % is $Fe_2O_3$, and 17 wt. % other components, according to analyses which have been carried out.

The separation of the distillate occurs at a pressure of 0.1 bar, with the hydrogenation residue heated from 250° to 350° C. in the screw extruder 7 during the distillation. Eightly weight percent of the distillable components of the oil fraction are volatilized and are drawn off from the evaporation zone 18 via the pipes 9, cooled (not shown), and further drawn away via line 10, condensate container 13, and line 15.

In tests, softening point of the residue after passing through the evaporation zone 18 was 180° C. The viscosity of this residue at 250° C. was measured to be 1,500 mPas.

The distillable components withdrawn via line 15 may be recycled to the hydrogenation system, as valuable components of the comminuation oil.

The evaporation zone 18 is separated from the low temperature carbonization zone 19 by a mechanical compression stage 11 employing known technology with a suitable screw configuration and with the disposition of suitable screw elements in this compression stage region. In this compression stage, the residue is pressurized, which reside is comprised of only 10 wt. % (based on the original residue fed) of residual oils, with the rest of this residue comprising inorganic components and higher molecular weight intermediate products. The pressurized residue is then fed to the low temperature carbonization zone, 19, where it is heated to 600° C. In said zone an additional 20 wt. % of distillate product (based on the original residue fed) is liberated, which is withdrawn from said zone through lines 16 and 17. This product also may be recycled for use as a valuable component of the comminution oil in the hydrogenation.

The residue after the low temperature carbonization was found to be comprised of 87 wt. % of inorganic components and 13 wt. % of other residue components, particularly coke-like products. It was passed through a pressurization zone 12 and withdrawn via lines 20 and 21.

Although it was feared that coke would accumulate on the screw in the low temperature carbonization zone, such was not observed.

The screw extruder is jacket-heated with superheated steam, in the evaporation zone, and with flue gas in the low temperature carbonization zone.

Alternatively, of equal technical merit, the screw extruder may be heated by electrically heated jaw pieces, by induction heating, or by heat transfer oil flowing in the jacket of the screw extruder.

What is claimed as new and intended to be secured by Letters Patent is:

1. A method for low temperature carbonization of coal hydrogenation residues, which comprises:

subjecting a coal hydrogenation residue to reduced pressure distillation in a screw extruder comprising an evaporation zone and a low temperature carbonization zone, which zones are separated from each other by means of a mechanical compression stage, and having a liquid space at its entry, thereby producing gases and vapors and a non-volatilized remaining material;

drawing off said gases and vapors; and subjecting said non-volatilized material to low temperature carbonization in said screw extruder.

2. The method according to claim 1, wherein said distillation is carried out at pressures of from about 0.01 to 0.6 bar.

3. The method according to claim 2, wherein said pressures are from about 0.02 to 0.1 bar.

4. The method according to claim 2, wherein said pressure decreases over the length of an evaporation zone of said screw extruder beginning at a point of entry of said hydrogenation residue, with said pressure decrease being from about 0.6 bar to about 0.01 bar.

5. The method according to claim 4, wherein said pressure decrease is from about 0.1 to about 0.02 bar.

6. The method according to claim 1, wherein said distillation is carried out at temperatures of from about 20° to 400° C.

7. The method according to claim 6 wherein said temeratures are from about 250° to 350° C.

8. The method according to claim 6, wherein said temperature increases over the length of an evaporation zone of said screw extruder, beginning at a point of entry of said hydrogenation residue and extending to a point of exit of said residue, with said temperature increase being from about 200° to about 400° C.

9. The method according to claim 8, wherein said temperature increase is from about 250° to about 350° C.

10. The method according to claim 1, wherein said low temperature carbonization is carried out from about 350° to 600° C.

11. The method according to claim 1, wherein said low temperature carbonization is carried out at atmospheric pressure.

12. The method according to claim 1, wherein said hydrogenation residue is fed into the screw extruder from the bottom of said extruder into said liquid space of said extruder, by means of a positive displacement pump system.

13. A method for the low temperature carbonization of coal hydrogenation residues, which comprises:

subjecting a coal hydrogenation residue to reduced pressure distillation in a screw extruder comprising an evaporation zone and a low temperature carbonization zone, which zones are separated from each other by means of a mechanical compression stage, thereby producing gases and vapors and a non-volatilized remaining material in said evaporation zone;

drawing off said gases and vapors; and subjecting said non-volatilized remaining material to low tsemperature carbonization in said low temperature carbonization zone of said screw extruder.

* * * * *

UNITED STATES PATENT AND TRADEMARK OFFICE

CERTIFICATE OF CORRECTION

PATENT NO. : 4,584,060

DATED : APRIL 22, 1986

INVENTOR(S) : WINCKLER, FUHRMANN, GRAESER, WENNING

It is certified that error appears in the above-identified patent and that said Letters Patent is hereby corrected as shown below:

In the Drawing, label the line connecting 4 with 8 as "5". (as per attached sheet)

Signed and Sealed this

Sixteenth Day of December, 1986

*Attest:*

DONALD J. QUIGG

*Attesting Officer* *Commissioner of Patents and Trademarks*

UNITED STATES PATENT AND TRADEMARK OFFICE

CERTIFICATE OF CORRECTION

PATENT NO. : 4,584,060

DATED : APRIL 22, 1986

INVENTOR(S) : WINCKLER, FUHRMANN, GRAESER, WENNING

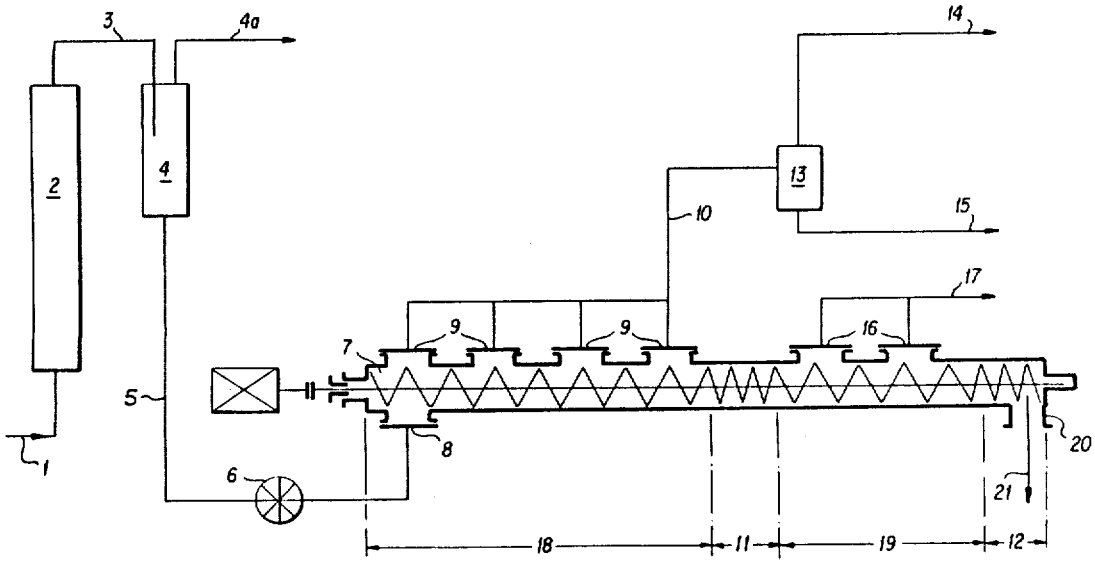

It is certified that error appears in the above-identified patent and that said Letters Patent is hereby corrected as shown below: